US007427917B2

(12) United States Patent
Rascoe et al.

(10) Patent No.: US 7,427,917 B2
(45) Date of Patent: Sep. 23, 2008

(54) TELEMETRY EMERGENCY AIR MANAGEMENT SYSTEM

(75) Inventors: Fred Rascoe, Lawrenceville, GA (US); Barry Martin, Suwanee, GA (US); John Morris, Dacula, GA (US)

(73) Assignee: Avon-International Safety Instruments, Inc., Lawrenceville, GA (US)

( * ) Notice: Subject to any disclaimer, the term of this patent is extended or adjusted under 35 U.S.C. 154(b) by 174 days.

(21) Appl. No.: 11/436,871

(22) Filed: May 19, 2006

(65) Prior Publication Data

US 2007/0052542 A1 Mar. 8, 2007

Related U.S. Application Data

(60) Provisional application No. 60/713,884, filed on Sep. 6, 2005.

(51) Int. Cl.
*G08B 1/08* (2006.01)

(52) U.S. Cl. ..... 340/539.11; 340/539.1; 340/573.1

(58) Field of Classification Search ..... 340/539.11, 340/539.1, 573.1
See application file for complete search history.

(56) References Cited

U.S. PATENT DOCUMENTS 5,990,793 A * 11/1999 Bieback ..... 340/573.1

* cited by examiner

*Primary Examiner*—Daryl C Pope
(74) *Attorney, Agent, or Firm*—Rodgers & Rodgers

(57) ABSTRACT

A system to monitor the status of a firefighter comprising a self contained breathing apparatus associated with the firefighter and operational with a microprocessor to transmit and receive signals by means of transceivers, a monitor to visually observe the signals, and a personal alert safety system operational with the apparatus to detect firefighter distress signals.

10 Claims, 1 Drawing Sheet

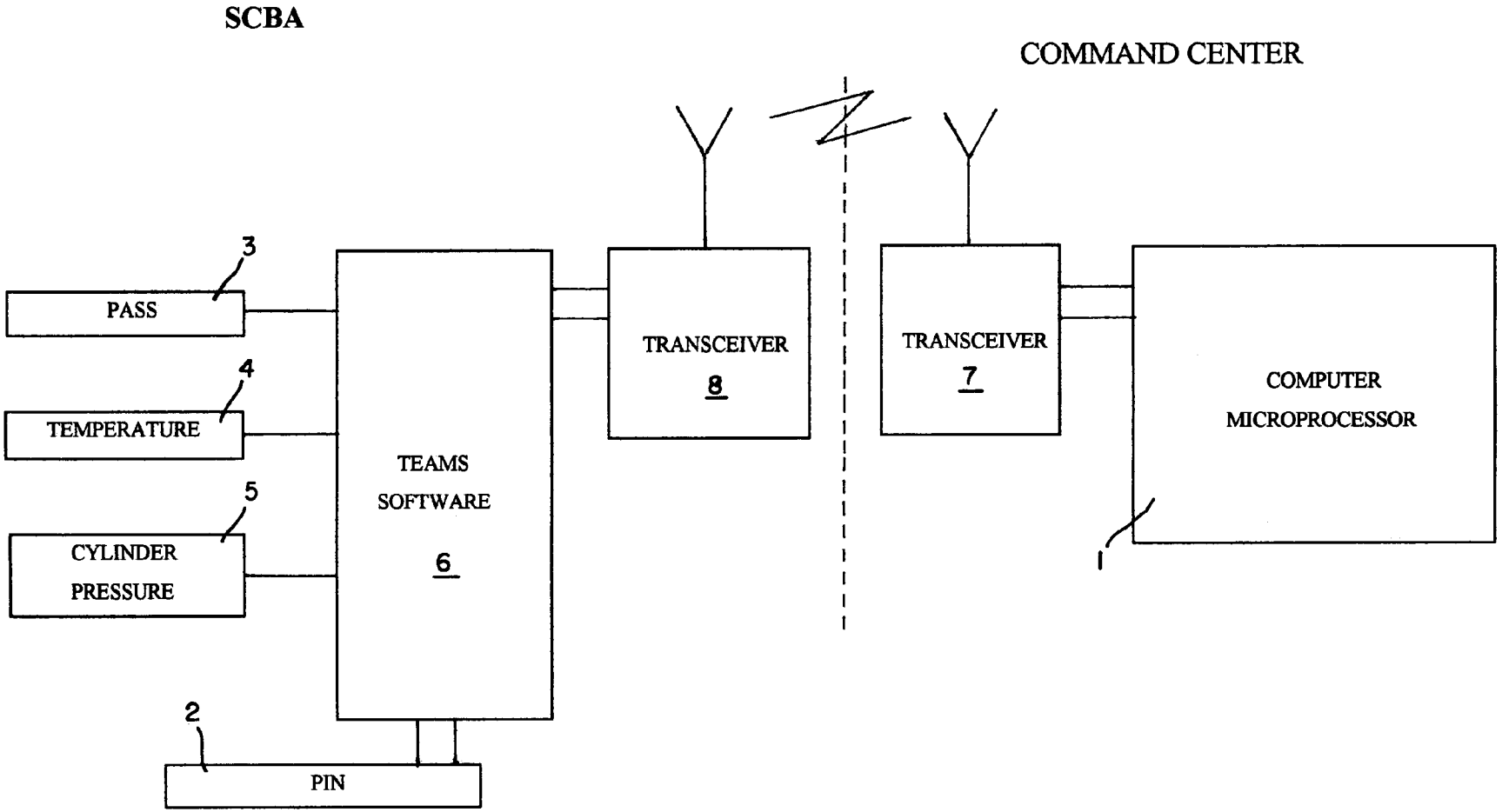
COMMAND CENTER
COMPUTER
MICROPROCESSOR
1
TRANSCEIVER
7
TRANSCEIVER
8
SCBA
TEAMS
SOFTWARE
6
PIN
2
3
PASS
4
TEMPERATURE
5
CYLINDER
PRESSURE

TELEMETRY EMERGENCY AIR MANAGEMENT SYSTEM

The benefits under 35 U.S.C. 119 are claimed of provisional patent application 60/713,884 filed Sep. 6, 2005.

BACKGROUND OF THE INVENTION

The National Fire Protection Agency (NFPA) is concentrating on systems that can track Personal Alert Safety Systems (PASS) for individual firefighters while at a fire scene. The PASS alarm is an audible alarm which sounds if a firefighter is immobile for a prescribed period of time, for instance, 30 seconds. If there is no movement, the alarm automatically activates a sound so that others can hear the alarm and attend to the rescue of the individual in distress. NFPA has requested development of systems that transmit the alarm signal wirelessly to a remote center so it can be visually displayed. This allows remote monitoring of the PASS status of a firefighter.

BRIEF SUMMARY OF THE INVENTION

The TEAMS system according to this invention comprises a command center, command center transceiver, software and individual transceivers on the firefighters SCBA. There is a compatibility to service up to 32 firefighters in the system at any one time.

The command center is a computer which runs the TEAMS software. The command center interfaces with the command center transceiver to communicate with each firefighter. Also the command center maintains a database of each firefighter and his/her personal data. Items tracked for each firefighter are as follows:

(a) Serial number
(b) Personal Identification Number (PIN)
(c) PASS status
(d) Ambient temperature
(e) Air pressure
(f) Time consumed The SCBA contains a transceiver system which communicates with the command center transceiver. Also, the SCBA has a three-digit programmable mechanism for firefighter identification.

BRIEF DESCRIPTION OF THE DRAWING

The single view drawing is a block diagram showing the basic features of the TEAMS according to the invention.

DETAILED DESCRIPTION OF THE INVENTION

Upon arriving at a fire scene, portable computer or microprocessor 1 is activated. Each firefighter, prior to turning on his/her SCBA, will key in a personal three-digit PIN 2 into the SCBA programmable mechanism, outside the fire scene. Then, the command center will individually poll each SCBA to inquire who is online and whoever is successfully polled is identified on the command center screen. Once this is accomplished, the command center is aware of whom is on site. During a fire, the command center will communicate individually with each firefighter's SCBA. This communication process is to gather data as to the current status of the firefighter. Each communication transmits the PASS status, i.e., body temperature, air pressure, heart rate and blood pressure to the command center which updates the data on the computer monitor.

If the firefighter's PASS 3 is caused to alarm, this is indicated on the command center monitor. The individual monitoring the command center knows that the firefighter is in a state of alarm and sends assistance. Also monitored is the ambient temperature 4. If the firefighter enters an area where the temperature exceeds a predetermined level, this results in an alarm and the firefighter's data is displayed in the screen alarm box. If a firefighter's cylinder air pressure 5 decreases to a predetermined level, this is considered an alarm and is displayed in the alarm box. Also, the time that the firefighter has been on pressurized air is monitored. This is an indication of the amount of time that the firefighter has been actively engaged at the scene and is a relevant parameter for the commander and is used to assure proper rehabilitation procedures.

The microprocessor and translates commands issued by the TEAMS software 6 into radio transmissions. The transmissions are received by the addressed SCBA, which then responds with a radio broadcast which is received by the command center. The command center then sends this SCBA's response to microprocessor 1. The current communication method is a serial port connection. Other embodiments are also possible such as USB, Ethernet and GPIB. Wireless communication channels possible are WiFi, Bluetooth and ZigBee protocols. The power supply for the command center is a built-in rechargeable battery pack as well as an interface to power the unit from the line or fire truck power system. The electronic design of the command center consists of a 920 MHz FHSS (frequency hopping spread spectrum) transceiver that outputs one watt of radio frequency power in the unlicensed ISM (industrial, scientific, medical) band. This transceiver connects to an embedded microprocessor/microcontroller that contains flash memory that is in-circuit programmable. This embedded microcontroller contains the hardware necessary to connect the transceiver to the computer along with custom software to perform the above actions.

In general, an SCBA contains embedded electronics to monitor various physical parameters and communicate them to the user in a simple and understandable manner. These parameters consist of, but are not limited to, cylinder pressure 5, PASS status 3, battery voltage and overall unit status. To integrate the SCBA into the TEAMS network, it is necessary to include an onboard transceiver 7 capable of communicating with the command center.

The TEAMS ready SCBA contains a high performance embedded microcontroller connected to transceiver 8 that is compatible with the command center transceiver, i.e., the same hopping sequence, channel number, and rf output power. Unique features of this system are the ability of the microcontroller to query the transceiver and determine whether or not the SCBA is within communication range of the command center. In-range transceivers provide a sync pulse at prescribed intervals allowing a lock in the frequency hopping sequence. This allows them to sense whether or not another transceiver is present within its communication envelope. This in-range indication is in the form of an LED mounted on the thumbwheel interface that hangs over the user's shoulder during normal use. When the SCBA is able to communicate with the command center, the LED is illuminated. If the user is not within communication range of the command center, the LED is extinguished. This gives the user immediate feedback as to his link status with the command center.

In addition to the transceiver interface, the microcontroller is responsible for the implementation of the TEAMS communication protocol. This requires on board storage of various system parameters stored in EEPROM and flash memory resident inside the microcontroller.

Unique to the system is the manner in which each SCBA user is identified by name. In order to identify the user of a particular SCBA, the SCBA contains a thumbwheel interface. This interface is permanently mounted on the unit and allows the firefighter to key in a unique PIN. This PIN is transmitted to the TEAMS software via the command center during each SCBA command center event. The TEAMS software contains a database which contains PIN assignments. These assignments correlate a PIN to a name. This allows the TEAMS software to identify the actual user by name.

TEAMS is a software application designed to run on the Windows XP platform. The main purpose of the software is to provide the commander with the ability to monitor and recall fire team members either individually or universally.

The software is a real-time database application. This differs from a standard application due to the scanning sequence the software performs in order to sample and communicate SCBA status in a reasonable amount of time. The system operation begins by entering serial numbers into the database via an interface screen provided by a menu selection. The serial numbers of the SCBAs are entered into the database with this interface. These serial numbers are provided by the manufacturer at the time of sale so that each time the user purchases a new unit the new serial number can be added. A maximum of 32 units can be displayed at any one time so the maximum for one command center is 32. Another embodiment allows this number to be increased without limit. The software sorts the online users based upon the task selected. This allows grouping of firefighters to a particular task. Examples might be roof, basement, north quadrant etc.

There are four alarm possibilities, including PASS (this alarm is always on so no database interaction is necessary), low cylinder pressure, high temperature and time-in-fire. If the user clicks on a name in the alarm box, a detailed explanation of any and all alarm causes will appear in a box immediately to the right labeled Alarm Description.

One embodiment of the software design causes a software controlled recall to be issued to the firefighter in alarm status. Another embodiment allows the recall to be manual under human supervision. The correlation of the firefighter's personal information, i.e., name, address, emergency contact and PIN are also stored in a database that can be accessed via a menu selection.

When the software is executed by clicking its icon, the startup sequence first asks the user if the event data is to be logged to a database. If the answer is yes, then all runtime data that is gathered from the SCBAs are logged to the database for later retrieval. The software then loads the serial number database and sequentially communicates via the command center with each one. If a valid response is received, then the data is loaded into the appropriate location on the screen. The software then removes these serial numbers found from the available serial number scan list. This means that only those not online will be scanned the next time resulting in a shorter scan time. Polling then transmits a request for data to each SCBA online, receives the data, and updates the display. Each string of requested data is checked against the alarm set points. If a set point has been exceeded, the user's name is placed in an alarm status. A dynamic link to the alarm cause can be created by clicking on the name in the alarm box.

A unique feature of the software is the individual and universal recall capabilities. If the commander on scene determines that a particular firefighter needs to be recalled, he can press that individual's recall button. That recall button will turn red in color to signify that that firefighter has been issued a recall command. It will continue to transmit a recall command until it receives a response from the user. When a recall command has been received on the user's SCBA, the piezo alarm sounds for 10 seconds, during which time the firefighter cannot disable the alarm. At the same time, the heads-up display normally used to display cylinder pressure to the user flashes in a prescribed pattern to visually signal an evacuation command. After the 10 second alarm, the firefighter can locally disable the piezo alarm, but the heads-up display will continue flashing the evacuate sequence for 20 seconds out of every 60-second interval until the all-clear signal is given. When the command center receives an acknowledgement response from the firefighter's SCBA, the recall button will turn yellow. At this point the commander knows that firefighter has received the evacuation command, the piezo is sounding and he should be evacuating. When the firefighter has completed the evacuation, he presses and holds the PASS reset buttons on the SCBA for three seconds. This will cause the SCBA to transmit an all-clear acknowledgement to the command center. The recall button on the screen will then turn green and the software will remove the firefighter from the scanning sequence. This frees up the system to allow faster scanning for those still online. The green indication of the recall button is an immediate indication to the scene commander that that firefighter is clear of danger.

A universal recall is used when the global recall button is pressed. This is equivalent to pressing all the individual recall buttons simultaneously. The process is identical to the individual application with the exception that the software automates the pressing of the individual recall buttons. As each user receives the recall command, the color sequence is red, yellow, green and offline, as with the individual recall.

Unique to the recall event, either individual or universal, is the acknowledgement by both the SCBA and the command center that a recall has been received. In addition, the all-clear signal from the SCBA signals the command center that the firefighter is clear of danger.

The invention claimed is:

1. A system for monitoring the status of a firefighter comprising:

a self contained breathing apparatus (SCBA) associated with the firefighter, a first transceiver for transmitting and receiving signals from said apparatus to a microprocessor, a monitor for displaying data transmitted from said microprocessor, a second transceiver for transmitting and receiving signals from said microprocessor to said apparatus, a personal alert safety system operably connected to said apparatus and adapted to transmit firefighter distress signals to said microprocessor, a sync pulse transmitted by said first transceiver at prescribed intervals to sense other transceivers within communication range of said first transceiver, and an LED associated with said SCBA to provide a visual indication of the presence of said other transceivers and of when said SCBA is within communication range of said microprocessor.

2. A system according to claim 1 wherein a personal identification number is assigned to the firefighter and transmittable from said apparatus to said microprocessor.

3. A system according to claim 2 wherein a database is adapted to receive said signals from said personal alert safety system and wherein said database contains the firefighter's name.

4. A system according to claim 3 wherein a thumbwheel is operably connected to said apparatus to allow the firefighter to enter said personal identification number and wherein said personal identification number correlates to the firefighter's name stored in said database.

5. A system according to claim 1 wherein ambient temperature associated with said apparatus is monitored by said microprocessor.

6. A system according to claim 1 wherein cylinder air pressure associated with said apparatus is monitored by said microprocessor.

7. A system according to claim 6 wherein the time expended by the firefighter receiving air from said cylinder is monitored by said microprocessor.

8. A system according to claim 1 wherein a microcontroller is operable with said first transceiver to determine if said apparatus is in communication with said second transceiver.

9. A system according to claim 1 wherein multiple apparatuses are operably interconnected to said microprocessor and said microprocessor is adapted to send recall signal to all said apparatuses simultaneously.

10. A system according to claim 1 wherein said microprocessor is adapted to issue a recall signal to said apparatuses to activate a time specific alarm during which time the firefighter cannot disable said alarm.

* * * * *